US009925993B2

(12) United States Patent
Goforth et al.

(10) Patent No.: US 9,925,993 B2
(45) Date of Patent: Mar. 27, 2018

(54) SPEED PROFILING FOR LOCOMOTIVE DISPLAY AND EVENT RECORDER

(71) Applicant: New York Air Brake, LLC, Watertown, NY (US)

(72) Inventors: Wade Goforth, Carrollton, TX (US); Roger B. Lewis, Stem, NC (US)

(73) Assignee: New York Air Brake, LLC, Watertown, NY (US)

( * ) Notice: Subject to any disclaimer, the term of this patent is extended or adjusted under 35 U.S.C. 154(b) by 80 days.

(21) Appl. No.: 15/132,411

(22) Filed: Apr. 19, 2016

(65) Prior Publication Data

US 2017/0297594 A1 Oct. 19, 2017

(51) Int. Cl.
*B61L 27/00* (2006.01)
*B61L 3/00* (2006.01)

(52) U.S. Cl.
CPC ..... *B61L 27/0027* (2013.01); *B61L 3/006* (2013.01); *B61L 3/008* (2013.01); *B61L 27/0038* (2013.01); *B61L 27/0077* (2013.01)

(58) Field of Classification Search
CPC ..... B61L 27/0038; B61L 27/0077; B61L 27/0027
See application file for complete search history.

(56) References Cited

U.S. PATENT DOCUMENTS

2009/0118970 A1* 5/2009 Daum ..... B61L 3/006 701/102
2013/0325224 A1 12/2013 Yamamoto et al.

FOREIGN PATENT DOCUMENTS

| | | |
|---|---|---|
| AU | 2012261786 | 1/2013 |
| EP | 2799307 | 11/2014 |
| WO | 2015/098521 | 7/2015 |

OTHER PUBLICATIONS

International Search Report and Written Opinion Form PCT/ISA/220, International Application No. PCT/US2016/028217, p. 1-12, dated Jan. 17, 2017.

* cited by examiner

*Primary Examiner* — Michael D Lang
(74) *Attorney, Agent, or Firm* — Bond Schoeneck and King PLLC; David Nocilly

(57) ABSTRACT

A train speed profiling system for use in connection with a train management system that can generate a virtual profile of a predetermined route having an estimated time of arrival at a destination based on data specific to the route and the actual train that will travel on the route. The virtual profile may be adjusted for any acceleration and any deceleration required by the train, and then optimized for reduced fuel consumption by reducing braking effort and improving coasting opportunities over the route if the estimated time of arrival is earlier than a desired time of arrival. The virtual profile may further be conformed so that the estimate time of arrival matches the desired time of arrival within a narrow threshold.

15 Claims, 7 Drawing Sheets

SPEED PROFILING FOR LOCOMOTIVE DISPLAY AND EVENT RECORDER

BACKGROUND OF THE INVENTION

1. Field of the Invention

The present invention relates to train management systems and, more particularly, to a system for predicting arrival times based on a speed profile.

2. Description of the Related Art

Train management systems, such as the LEADER Locomotive Engineer Assist/Display and Event Recorder available from New York Air Brake, LLC of Watertown, N.Y., are designed to improve train handling and yield significant fuel savings. Such systems assist locomotive engineers in reducing fuel consumption while effectively managing trip time and minimizing in-train forces. While management systems can project train speed several miles into the future based on a simulation of the train at its current throttle settings, this projection is limited to just a few miles in distance and may be relatively inaccurate due to the inability to account for undulating territory. Accordingly, there is a need for a system that can more accurately predict train speed over longer distances and provide estimated arrival times beyond a short distance.

BRIEF SUMMARY OF THE INVENTION

The present invention comprises a train speed profiling system for use in connection with a train management system. The system includes a first module programmed to generate a virtual profile of a predetermined route having an estimated time of arrival at a destination based on data specific to the predetermined route and a train that will travel on the predetermined route. The virtual profile comprises a series of equidistant data points, each of which is associated with a speed limit representing the lowest applicable speed limit for the train at the corresponding location of the predetermined route. The first module is programmed to generate the virtual profile by loading the data from a configuration file, creating tables of operational information, generating a preliminary virtual profile having equidistant data points, and then finalizing the virtual profile by adjusting based on the maximum speed achievable by the train on any grades in the predetermined route.

A second module of the system is programmed to modify the virtual profile based on any acceleration and any deceleration required by the train when traversing the predetermined route. The second module is programmed to modify the virtual profile based on any acceleration and any deceleration by adjusting the speed limits for each data point based on the acceleration and deceleration that the train is capable of over the predetermined route.

A third module of the system is programmed to modify the virtual profile to reducing any braking effort of the train along the predetermined route. The modification of the virtual profile by the third module to reduce any braking effort only occurs if the estimated arrival time after modification of the virtual profile based on any acceleration and any deceleration is earlier than the desired arrival time. The third module is programmed to modify the virtual profile to reducing any braking effort by reducing the speed limits of each data point prior to each data point having a speed limit reduction. However, the third module is programmed to not reduce the speed limit of each prior data point if the reduced speed limit will fall below a minimum speed limit for such data point.

A fourth module of the system is programmed to modify the virtual profile to improve coasting along the predetermined route. The modification of the virtual profile to improve coasting by the fourth module only occurs if the estimated arrival time after modification of the virtual profile by the third module is earlier than the desired arrival time. The fourth module is programmed to revise the speed limit for each data point where the train requires less traction energy than a predetermined threshold.

A fifth module of the system is programmed to conform the estimated time of arrival to a desired time of arrival at the destination that is input by a user. The fifth module is programmed to conform the estimated time of arrival to a desired time of arrival by adjusting the speed limits of a group of data points, each of which has a speed limit that may be increased or decreased and has not been increased or decreased by any of the second, third, or fourth modules.

The system implements a method of generating a speed profile for a train that begins with allowing a user to input a destination and estimated time of arrival. Next, a virtual profile of a predetermined route having an estimated time of arrival at a destination is generated based on data specific to the predetermined route that is retrieved from a configuration file. The virtual profile is then modified based on any acceleration and any deceleration required by the train when traversing the predetermined route as determined from the data specific to the predetermined route. The virtual profile may also be modified to reducing any braking effort of the train along the predetermined route if the estimated time of arrival is earlier than a desired time of arrival input by a user. The virtual profile may be further modified to improve coasting along the predetermined route if the estimated time of arrival is earlier than the desired time of arrival input by a user. As a final step, the virtual profile is modified to conform the estimated time of arrival to a desired time of arrival at the destination that is input by a user.

BRIEF DESCRIPTION OF THE SEVERAL VIEWS OF THE DRAWING(S)

The present invention will be more fully understood and appreciated by reading the following Detailed Description in conjunction with the accompanying drawings, in which.

DETAILED DESCRIPTION OF THE INVENTION

Figure 1:
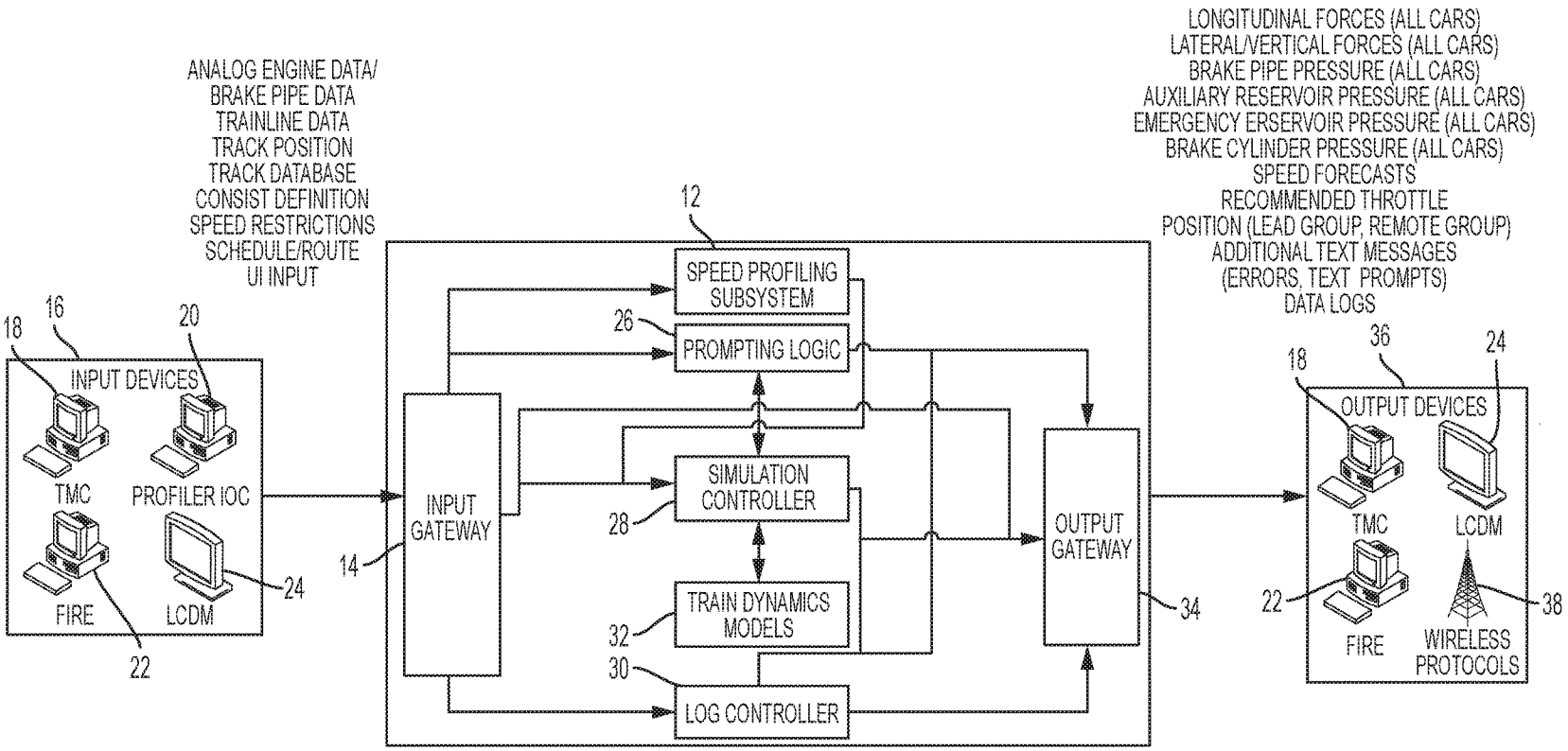
FIG. 1 is a schematic of a train management system having a speed profiling subsystem according to the present invention.

Referring now to the drawings, wherein like reference numerals refer to like parts throughout, there is seen in FIG.

1 a train management system 10 that includes a speed profiling subsystem 12 for more accurately estimating future speeds and arrival times. System 10 also includes an input gateway 14 for obtaining data used in managing a train. For example, input gateway may receive inputs from user interfaces 16 such as a train management computer (TMC) 18, an instrumented order car (IOC) platform 20, functionally integrated railway electronics (FIRE) computer 22, and a locomotive cab display module (LCDM) 24. Data collected includes engine data, brake pipe data, trainline date, track position, track databases, consist definitions, speed restrictions, scheduling and route information, and inputs from user interfaces 16.

The data received by input gateway 14 is processed by speed profiling subsystem 12 as well as prompting logic 26, a simulation controller 28, and a log controller 30 according to predetermined parameters. The data processed by these subsystems may be provided to a train dynamics module 32 for determining forces involved in a simulation. System 10 may then provide information via an output gateway 34 to various output devices 36, such as TMC 18, FIRE 22, LCDM 24, and even remote stations 38 according to wireless protocols. System 10 outputs may include longitudinal forces on rail cars, lateral/vertical forces on rail cars, brake pipe pressure, auxiliary reservoir pressure, emergency reservoir pressure, brake cylinder pressure, as well as speed forecasts, recommended throttle positions, error messages and prompts, and a data logs. Preferably, speed profiling subsystem 12 has a closed application interface and only communicates with internal systems.

For precise profiling by speed profiling subsystem 12, system 10 must be provided with accurate consist and route information from an external source, such as railroad back office system, via input gateway 14 for each train equipped with speed profiling subsystem 12. For example, speed profiling subsystem 12 requires an accurate track profile that includes grade magnitude and location, curve magnitude and location, and the location of mile markers. In addition, speed profiling subsystem 12 is also provided with the direction of travel so that the magnitude of the grades and curves can be properly interpreted. Single or multiple destinations may be provided to speed profiling subsystem 12. Preferably, each destination is paired with a time target, i.e., the time that the train should be at each destination, so that speed profiling subsystem 12 can create energy optimized speed profile for achieving the time target(s). A complete set of speed limits for the particular route may also be input into speed profiling subsystem 12, and may include civil speed limits, any temporary speed restrictions, train type speed restrictions, user specified speed limits, and all known signaled speed restrictions.

Consist information is also needed by speed profiling subsystem 12, and generally includes the number of cars in the train, the number of locomotives, the weight of each car, the weight of each locomotive, the frontal area of each car, the frontal area of each locomotive, the number of axles on each car, the number of axles on each locomotive, tractive effort (TE) verses speed curves for each locomotive, dynamic brake (DB) verses speed curves for each locomotive.

Calculation of the equations of motion for the active consist by speed profiling subsystem 12 require the use of resistance efficiencies such as dynamic brake efficiency, tractive effort efficiency, curve resistance efficiency, and rolling resistance efficiency. Preferably, an acceptable tolerance range of efficiencies may be programmed into speed profiling subsystem 12, such as zero to 3.0 (three hundred percent). Any input efficiencies outside the tolerance will produce an error message from speed profiling subsystem 12.

Speed profiling subsystem 12 is programmed to process the input data and provide several outputs. First, speed profiling subsystem 12 outputs a list of track locations paired with speed limits as a response to a calling procedure, i.e., a request for processed information from another subsystem. Second, speed profiling subsystem 12 outputs a time to any input destinations. In the event of an error in determining either of these outputs, an error code is output in response to a calling procedure.

Speed profiling subsystem 12 is preferably included as a part of the software that implements system 10 and performs a series of calculations based on inputted data for accurate profiling. If speed profiling subsystem 12 is to be activated, such as by a user selecting the output of a speed profile at a user input 16, the user may be prompted as part of a login sequence or process to input one or more destination if none have been provided. Similarly, the user may be prompted to input desired ETA using user input 16 if not previously provided. These inputs may be displayed on user input 16 for confirmation. A user may also indicate whether speed profiling subsystem 12 should calculate an estimated fuel consumption.

Once the login process has been completed, speed profiling subsystem 12 can generate a virtual profile. Speed profiling subsystem 12 calculates the maximum tractive effort and maximum dynamic brake effort based on the composition of the consist. For example, locomotives in a consist may operate in the states of active, isolate, no DB, DB only, and dead. As described above, the number of locomotives and the state of each locomotive may be input or configured from consist configuration screens provided by system 10 at the user inputs 16. Speed profiling subsystem 12 also calculates total available tractive effort with distributed power based on the assumption that any active remote locomotives will be operated in the synchronous distributed power state for the purposes of calculating total tractive effort. Speed profiling subsystem 12 may then calculate a speed profile that meets a desired ETA within a threshold, such as two percent.

During operation of the train, prompting logic 26 can generate and send prompts to user via output gateway 34 to operate the train according to the calculated virtual profile. It should be recognized that highly variable and unpredictable conditions mean that the speed profile will not be followed exactly. For example, inaccurate consist information, inaccurate track profile information, schedule changes, route changes, and train handling requirements can result in deviations from the speed profile. As a result, speed profiling subsystem 12 is programmed to provide real-time feedback to the engineer that reflects deviations from the speed profile and to provide prompts to the user that will assist in maintaining the desired schedule when there are deviations from the speed profile. For example, once a virtual profile is calculated, speed profiling subsystem 12 can cause the display of an initial expected arrival time at each destination. The display of the initial expected arrival time may be updated in real-time based on the actual operating conditions to reflect changes in the expected arrival time due to deviations from the initial speed profile. Speed profiling subsystem 12, via prompting logic 26 and output gateway 34, may also prompt the train operator to make changes that are calculated to achieve the initial predicted time to one or more previously input destinations with a predetermined threshold, such as five percent. Speed profiling subsystem 12 may also allow, via user input 16, a user to manually adjust the desired ETA while en route to the destination.

Figure 2:
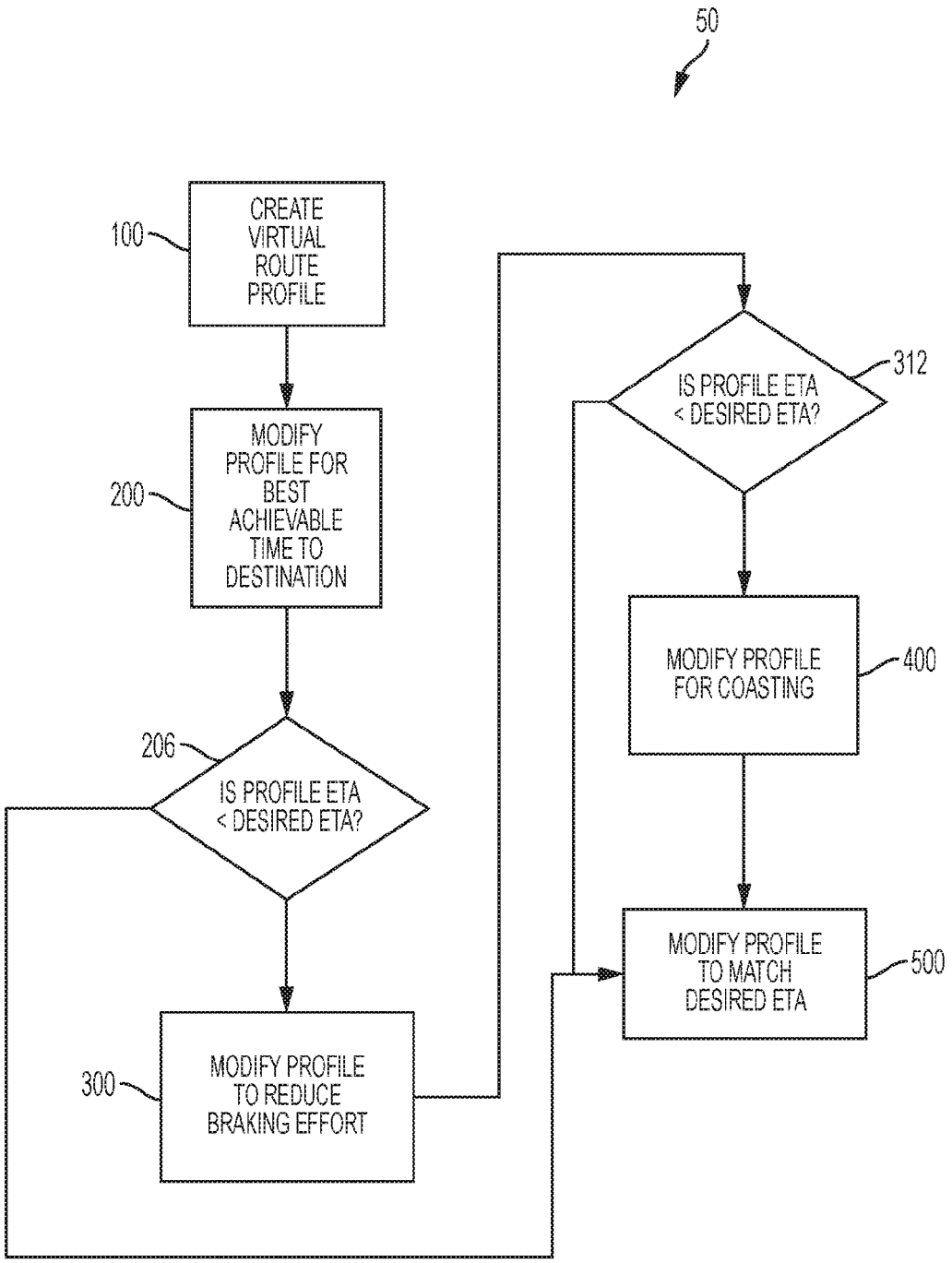
FIG. 2 is a flowchart of a virtual profile process according to the present invention.

Referring to FIG. 2, once all required data has been input and the relevant tables have been calculated, speed profiling subsystem 12 implements a speed profile generation process 50 that produces a virtual profile governing the operation of the train. The virtual profile extends from the present location of the train to one or more destinations via a series of virtual speed limit (VSL) values that assigned to each data point representing each equidistant location point along the route. A creation of a virtual profile assumes that consist information is known, complete, accurate, and does not change, and that the route is known, complete, accurate, and does not change once established. The first step of speed profile generation process 50 is to create a virtual route profile 100 having a schedule for the operation of the train over the desired route and a profile ETA for each desired destination. The next step 200 is to modify the profile to determine the best realistically achievable profile ETA by taking into account acceleration and deceleration that must occur over the route. If the profile ETA as modified by step 200 is less that the desired ETA, the braking effort in the profile is modified in step 300 to improve fuel consumption. If the profile ETA continues to be less than the desired ETA, the profile may be further modified in step 400 to improve fuel consumption by identifying opportunities for coasting along the route. Once the profile has been modified for braking effort and coasting, or if the profile ETA exceeds the desired ETA at any point, the profile may be modified in step 500 to match the desired ETA.

Figure 3:
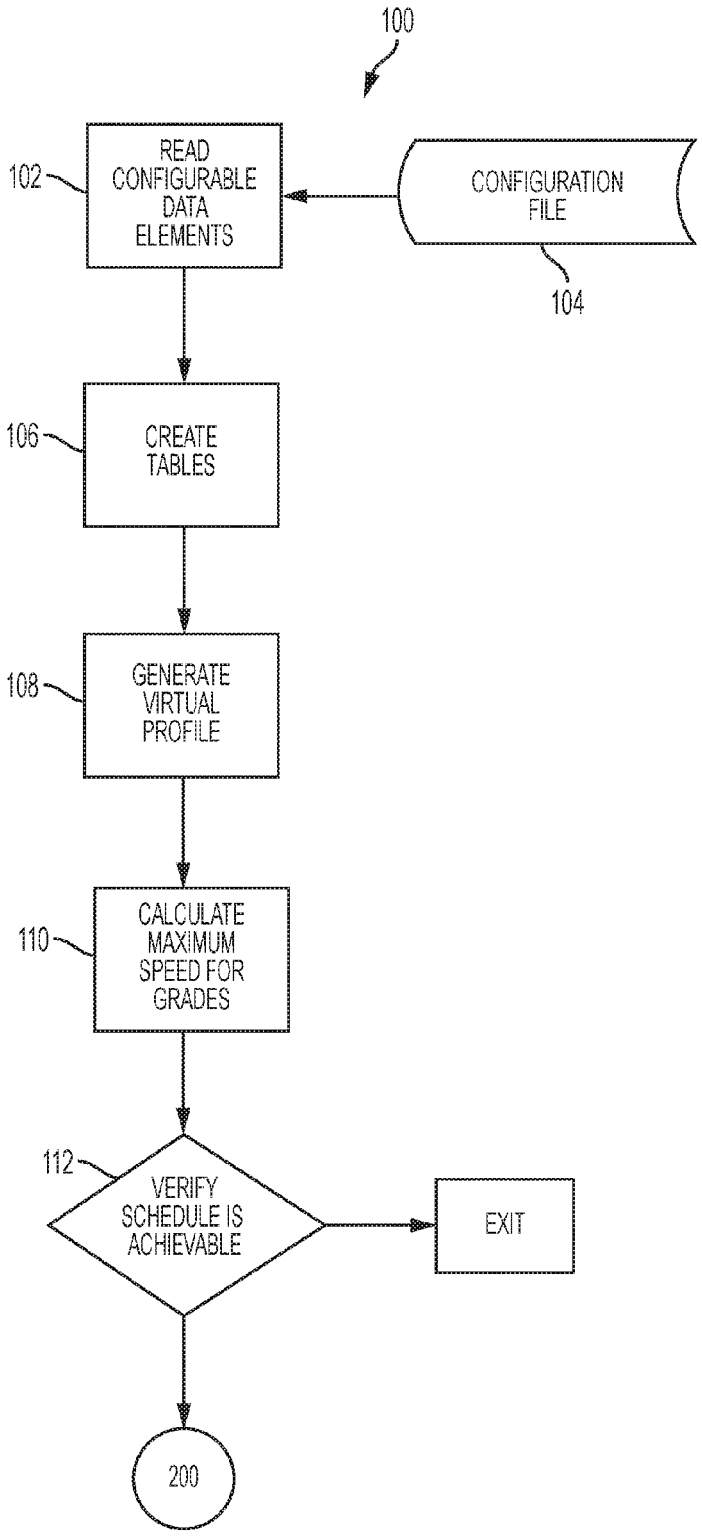
FIG. 3 is a flowchart of a virtual profile generation process according to the present invention.

Referring to FIG. 3, the creation of a virtual route profile in step 100 begins with the reading of all configuration data 102, such as by loading the data from a configuration file 104 established by train management system 10 based on user input and other available data sources. As explained above, a desired ETA for each destination on the selected route may be input and used to optimize train operation. The data also includes the initial velocity from which the virtual profile will commence and any minimum speed information for points along the route. The initial velocity could be retrieved from train management system 10 as the train may be moving when speed profiling subsystem 12 is triggered to produce a speed profile. The data should also include DB efficiency (a linear scaling parameter that modifies dynamic brake effort), TE efficiency (a linear scaling parameter that modifies tractive effort), RR efficiency (a linear scaling parameter that modifies rolling resistance effort), curve efficiency (a linear scaling parameter that modifies curve resistance effort), and DB position (the dynamic brake handle position).

From the data retrieved from the configuration file, speed profiling subsystem 12 creates a series of tables 106 containing operational data based on the configuration data. For example, the tables may include composite throttle tractive effort verses speed, which comprises the combined tractive effort of all locomotives in each notch position from idle to 8 in 0.1 mph increments up to a maximum velocity, such as 70 mph, using standard units, such as pounds verses mph. The tables may further include composite DB effort verses speed, which is the combined dynamic brake effort of all locomotives in all DB positions from setup to 8. The tables may additionally include composite rolling resistance force verses speed, which is the combined rolling resistance force of all cars in the train as a function of velocity using the formula $R(V)=\Sigma A+\Sigma BV+\Sigma CV^2$. The tables should also include data reflecting airbrake reduction force verses time, which may be determined by simulating a predetermined airbrake reduction, such as 10 psi, and then calculating and summing the increasing shoe force at each car over the time it takes for the brake cylinders to charge. Finally, the tables may include airbrake release force verses time, which is obtained by simulating a brake release after a predetermined reduction, such as 10 psi, and calculating and summing the decreasing shoe force at each car over the time it takes for the brake cylinders to discharge.

Using the charts and retrieved data, virtual profile creation process 100 may then generate a virtual profile 108 that extends from a starting point, such as the train location or a particular mile post, to the destination(s). The virtual profile comprises a series of equidistant locations or data points, each of which is associated with relevant route and train information. For example, each data point of the virtual profile should include the applicable milepost number on the route, the composite grade energy as determined by the average grade upon which all of the cars in the train lie when the lead locomotive lies on the given data point, and a virtual speed limit (VSL) that, as a default, is represented by the lowest known and applicable speed limit at that location. Each data point should also include the applicable speed limit that represents the lowest track speed limit applicable to the train in the location that each data point represents.

For the purposes of speed profiling subsystem 12, speed limits in a virtual profile apply to the head end of the train, but speed limits on a real track profile may apply to the head end only, or to the whole train, so the speed limit applicable to each point on the virtual profile must be evaluated carefully so that the data is consistent along the route. The virtual profile may also include, for each data point, the grade and curve resistances as determined by averaging the resistance on each car when the lead locomotive lies upon the data point. Grade and curve resistance may be saved as separate values so that separate efficiencies may be applied to them if necessary. Each data point should also include rolling resistance as determined by the composite rolling resistance value at the VSL speed. Each data point further includes a speed limit change to lower flag that comprises a binary flag set for the data point when the actual track speed limit at the data point is lower than the track speed limit at the previous point. Alternatively, this information could also be incorporated by creating a separate table with a list of data points for which this condition is applicable. Each data point also includes a speed limit change to higher flag that comprises a binary flag that is set for a data point when the actual track speed limit at the data point is higher than the track speed limit at the previous point. As before, this function could also be incorporated by creating a separate table with a list of data points for which this condition is applicable. Each data point should also include a steep flag, which is flag that is set for a data point when the horsepower required to meet track speed at the data point is greater than the horsepower that the locomotives are capable of supplying. This function could also be facilitated by creating a separate table with a list of data points for which this condition is applicable. To define a point as steep for the profile, the point may be evaluated to determine whether the acceleration of the train at the location, which may be calculated from standard train dynamic formula, is less than zero.

As will be explained below, each data point may further include a first flag indicating a point where braking should occur ("brake flag"), a second flag that identifies data points modified for coasting to speed limit changes ("CoastSL"), a third flag that identifies data points modified for coasting ("coast flag"), and a fourth flag that identifies data points that have modified by speed profiling subsystem 12 to achieve a desired schedule ("schedule flag"). Each data point may optionally include a firth flag that is a location where coasting is possible ("balance point flag"). For example, if the G+R+C sum of a data point is negative and the G+R+C sum of the previous data point is positive, the data point may be flagged with a balance point flag. This function could also be facilitated by creating a separate table with a list of data points for which this condition is applicable Once the virtual profile has been generated 108, the maximum speed for grades may be calculated 110. Each data point from the departure data point to destination data point that has an active steep flag is assigned a maximum achievable speed. The maximum achievable speed may be calculated by starting with VSL of the first data point in which a steep flag is active and, using that VSL as an initial speed, the G+R+C resistances and the composite tractive effort used to determine the train speed at the next data point. This process then continues from data point to data point until the calculated maximum achievable speed of a data point matches its applicable speed limit. Once the applicable speed limit for the data point is achieved, processing moves forward to the next data point nearest the departure point having an active steep flag. The velocity of the train at the next data point is then be calculated using conventional dynamic formula and becomes the VSL for that data point. This calculation is repeated to calculate the velocity of the train at the following data points until the calculated velocity for a data point is equal to or greater than the existing VSL at that data point. Once the velocity for each data point is calculated, the virtual profile is complete. The only time the velocity as a data point would be greater than the existing VSL is at the boundary of a speed restriction. When either of these conditions is met, processing moves forward (towards destination) to the next steep data point and the calculation is repeated. If the calculation of velocity becomes negative, an error message indicating that the train is not capable of maintaining positive velocity on this track profile should be broadcast and the speed profiling procedure ends.

Once the virtual profile has been initially calculated, a check may be performed to verify that the destination can be reached by the desired ETA by determining the time required to traverse all of the data points. If the desired ETA is not achievable, process 100 is exited. If the virtual profile defines a schedule that can meet the desired ETA, the virtual profile is considered to be operations and includes sufficient statistical information such that the actual track profile is no longer needed by speed profiling subsystem 12.

Figure 4:
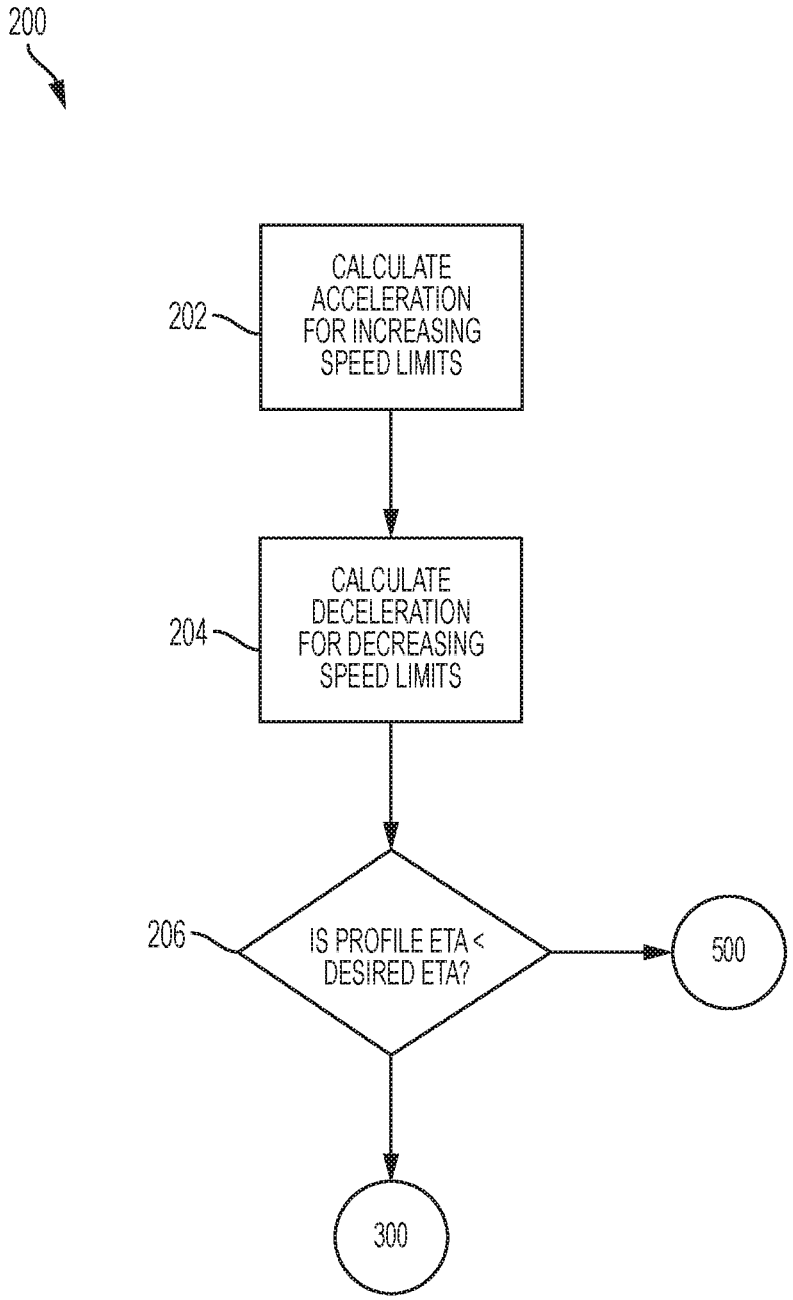
FIG. 4 is a flowchart of a virtual profile optimization process according to the present invention.

After the virtual profile creation process 100 is complete, speed profiling subsystem 12 can further modify the virtual profile to optimize the operation of the train over the route, e.g., to improve fuel economy. As explained above, the initial virtual profile may be modified in step 200 to determine the best realistically achievable profile ETA by taking into account acceleration and deceleration that must occur over the route. Referring to FIG. 4, the acceleration for increasing speed limits is calculated 202. Working from departure data point to destination data point, each data point where the speed limit changes to a higher value is flagged. These flagged points should have a VSL equal to the previous (lower) speed limit. Alternatively, the composite power verses speed table may be used to determine which notch would provide the tractive effort necessary to achieve the previous (lower) speed limit. The succeeding VSLs may then be calculated while accounting for a gradual increase in power between the calculated notch and notch 8. Once the relevant data points are flagged, the composite power verses speed table is used with notch 8 effort to set the VSL equal to the calculated speed for each successive data point until the new speed limit is reached. Each calculated speed should not exceed the value of any previously modified VSL, e.g., the steep data points. At a location where the speed limit changes, the VSL is reset to be equal to the previous speed limit unless the VSL is already less than the speed limit. This step can be circumvented by setting VSLs at speed limit increases to the previous speed limit during step 100. Equation 1 and Equation 3 are used to determine what the VSL should be at the next data point as $V_f$ becomes the VSL at the next data point. From the next data point, this procedure is repeated to calculate the velocity of the train at the next, e.g., third, data point. This process continues along the data points until a $V_f$ for a data point is equal to or greater than the existing VSL for that data point.

Next, the deceleration for decreasing speed limits 204 is calculated. For each data point marked with a speed limit change to lower flag, the maximum realistic braking effort must be calculated. The maximum realistic braking effort is defined as the maximum dynamic braking effort combined with a predetermined brake pipe pressure reduction, such as 10 psi. This step determines the location at which air brake and dynamic brake effort should be applied so that the final velocity of the train is equal to the new speed limit as close as possible to the data point associated with the location where the new speed limit starts. In this step, no calculated VSL may exceed any previously calculated value. If an existing VSL is lower than a calculated value, no more calculations are necessary for the speed restriction in question. If any data point prior to the speed limit decrease has a VSL that is lower than the new speed limit, a brake application cannot occur prior to this point. If this restriction causes a brake application to be required within a time frame that is shorter than the time required for the brake pipe to stabilize, then all VSLs between that point and the new speed limit must be equal to the new speed limit. One approach to this calculation is to use only the maximum DB effort. Another approach is to fix a deceleration rate at a predetermined amount, such as 7 MPH/min, and begin calculating the reduction from the data point where the speed restriction is located and work backwards to determine the data point associated with the location where braking must be initiated to achieve the required reduction in speed by the data point having the new speed limit.

Once the acceleration and deceleration have been calculated and the VSLs of the data points in the virtual profile have been adjusted, the virtual profile should represent the best realistically achievable ETA. The adjusted VSLs in the speed profile may then be used to determine a revised profile ETA which is checked against the desired ETA 206. If the revised profile ETA is greater than the desired schedule, control passes to step 500. If the revised ETA is less than or equal to the desired ETA, processing may continue to step 300.

Figure 5:
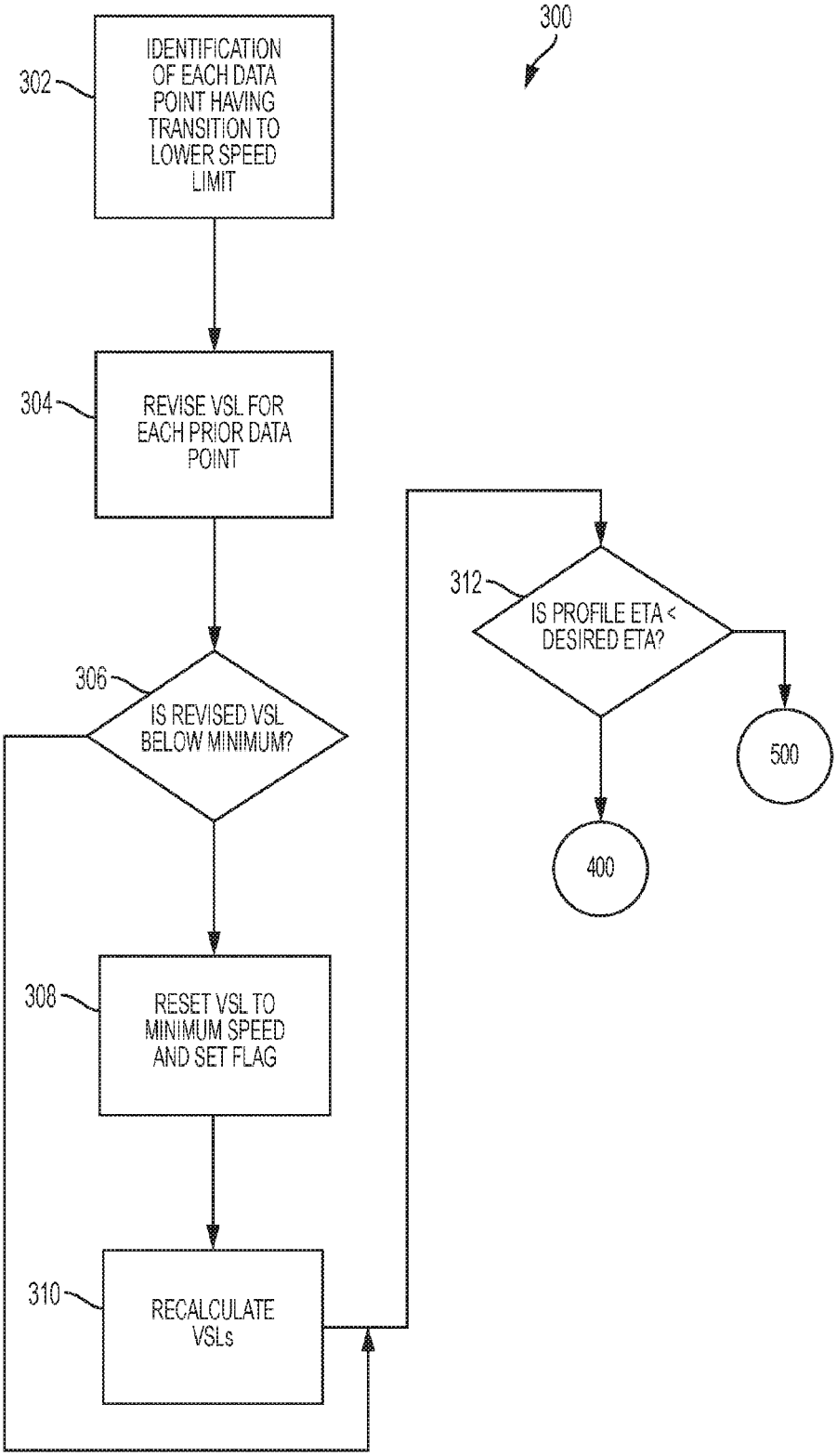
FIG. 5 is a flowchart of a virtual profile braking reduction process according to the present invention.

Referring to FIG. 5, a virtual profile having a best achievable ETA may be further modified in step 300 to reduce braking effort and thus improving fuel economy over the route while meeting the desired ETA. In many cases, not every speed restriction can be fully optimized while still meeting the schedule, so step 300 is preferably configurable by a user to achieve a predetermined level (or range) of braking reduction that balances fuel saving with the need to match a desired ETA. Braking effort reduction in step 300 begins with the identification of each data point or location where there is a transition to a lower speed limit 302.

Beginning at the first data point with a transition, a revised VSL is calculated for each prior data point 304, i.e., each data point closer to the starting point, assuming that no traction or braking effort is applied (effectively coasting). This routine continues until the revised VSL for a prior data point is equal to an already-calculated VSL for that data point. This operation is repeated at each subsequent data point where a speed restriction has been flagged. The revised VSL ($V_i$) may be calculated using standard formula for determining train acceleration. The resulting $V_i$ will become the VSL at the data point closer to the start of the route. From this data point, the process is repeated to calculate the velocity of the train at the next data point closer to the start of the route. The process continues until the revised VSL ($V_i$) for a data point is equal to or greater than the existing VSL for that data point.

As seen in FIG. 5, step 300 also includes consideration of any minimum speed restrictions. In practice, trains are not allowed to travel below a given minimum speed. This data may be a configurable input and can be supported within step 300 by checking whether the revised VSL at each data point are less than the minimum speed. If so, the revised VSL is reset to the minimum speed and a flag is set denoting the resetting of the VSL to the minimum speed. This process continues according to Equation 4 until the revised VSL at a data point equals the maximi achievable VSL as calculated in step 200. VSLs are then recalculated for previous data points, i.e., towards the destination point. Equation 3 may be used to solve for $V_f$. If a newly calculated VSL is greater than the VSL calculated in step 200 for that data point, the new VSL of that data point is set to be equal to the VSL calculated in step 200. This process may cease when the first data point edited for braking effort reduction above has been revised to address minimum speed restrictions. If every speed restriction can be fully optimized (maximum coasting) while still estimating an arrival time that is faster than the schedule, then step 300 is complete. It is likely, however, that not every speed restriction can be fully optimized while still meeting the schedule so, as before, user configurable level (or range) of speed restriction optimization reduction that balances fuel saving with the need to match a desired ETA may be employed.

If a check 312 determines that the profile ETA remains less than the desired ETA, the profile may be modified to improve coasting opportunities in step 400 and thus save traction energy by reducing braking effort wherever possible. If check 312 determines that the profile ETA has exceeded the desired ETA, control passes to step 500.

Figure 6:
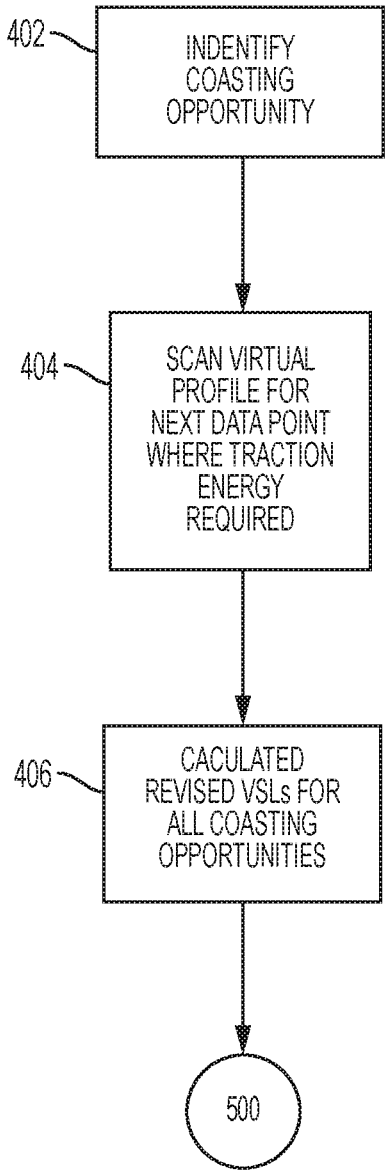
FIG. 6 is a flowchart of a virtual profile coasting optimization process according to the present invention.

Referring to FIG. 6, step 400 begins by identifying coasting opportunities, which are data points where required traction or DB energy is less than a configurable threshold, referred to as DB position for coasting, such as DB2. Once each data point is found, a scan is performed 404 forward along the route until a data point requiring positive traction energy is found. At this location, and all other identified coasting opportunities, the calculation explained above with respect to step 300 is used to calculate revised VSLs 406. For a data point, represented by x, the tractive effort values to be evaluated for step 400 can be calculated using conventional train dynamic formula Once step 400 has concluded, or if the profile ETA exceeds desired ETA at checks 206 or 312 speed profiling subsystem 12 performs modification step 500 to match the virtual profile to the desired schedule. If the estimated ETA after process is greater than the desired ETA, then coasting will be reduced in order to raise the average train speed. If the estimated ETA is less than the desired ETA, then certain data points may be edited with the goal of reducing their VSLs in order to achieve a speed profile that matches the desired schedule to within a small threshold, such as one percent. Final modification process 500 may be executed more than one time. As a result, the modifications to the data points in the virtual profile are made to the data points as they existed prior to step 500 or after step 500 has been previously executed.

Figure 7:
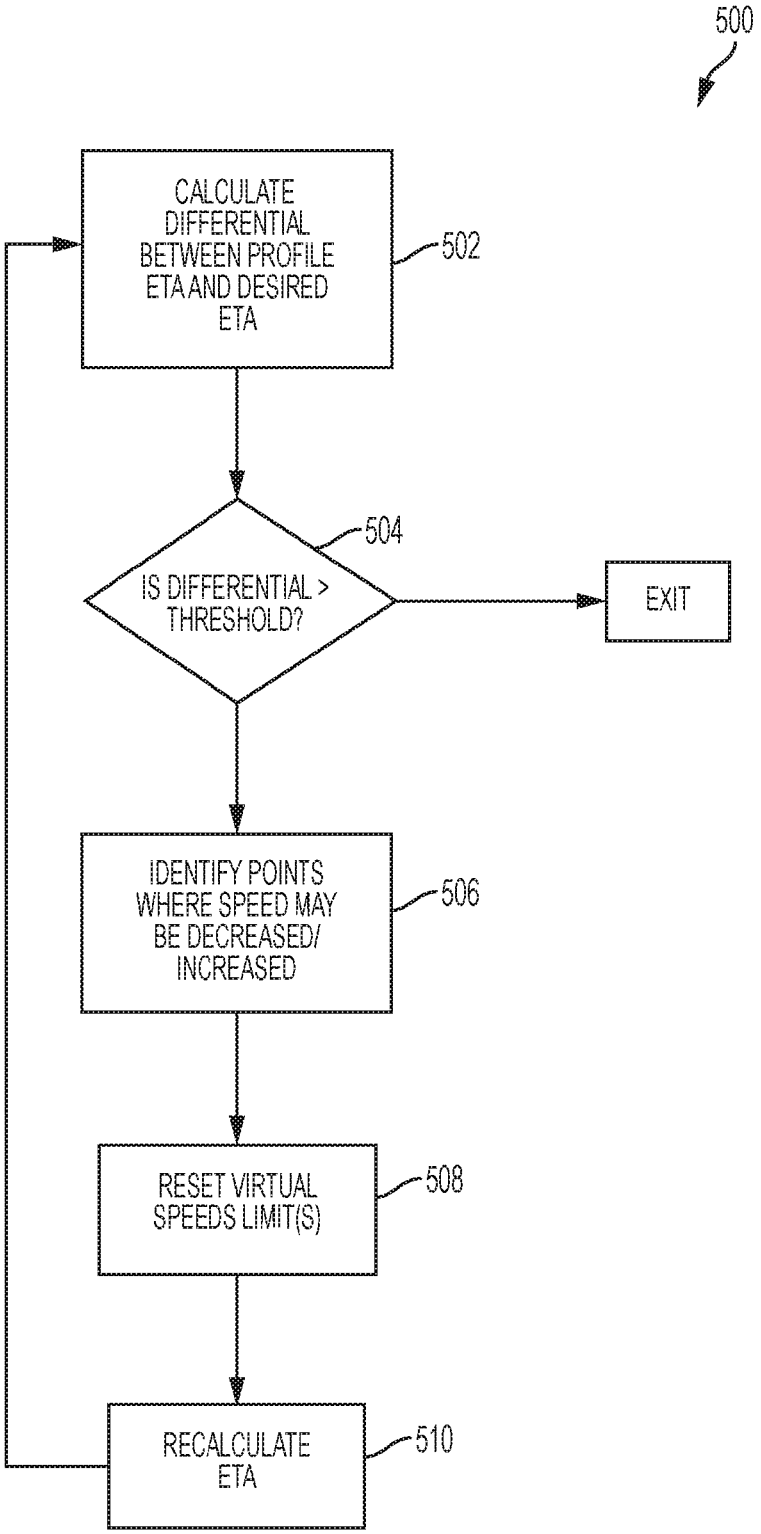
FIG. 7 is a flowchart of a virtual profile matching process according to the present invention.

Referring to FIG. 7, the first step in modification process 500 is to calculate the differential between the profile ETA and the desired ETA 502, i.e., the time that needs to be added or subtracted from virtual profile to match the desired schedule. If a check 504 determines that the differential 502 is within a predetermined threshold (which may be programmed as a default or configured by a user), such as ninety-nine percent, the virtual profile is complete and all processing can exit. If the differential exceeds the predetermined threshold, data points having VSLs that can be increased or decreased to more closely match the desired ETA are identified 506. The VSLs of those data points are then reset 508 and a new profile ETA is calculated 510. Step 500 may then be repeated to determine if the new profile ETA satisfies the matching threshold and, if not, processing of step 500 may repeat until the threshold is satisfied.

If the time differential is negative, i.e., the profile ETA is less than the desired ETA, data points that may have their VSLs decreased are identified using the following criteria: the estimated throttle position is greater than DB2 (or as otherwise configured by a user), the speed is greater than a threshold such as 10 MPH (or as otherwise configured by a user), and the data point has not been flagged for coasting or braking in steps 200, 300, or 400. If data points that meet the above criteria exist in groups of at least twenty consecutive points, those data points are flagged for editing. When all qualifying groups have been found, the data point with the highest-magnitude VSL between the current train location and destination is located, along with all other data points that have the same VSL value as the highest-magnitude VSL. Next, the data point with the second highest-magnitude VSL is identified and a check is performed to determine whether changing all of the data points having the highest VSL values to have the second-highest values will cause the calculated profile ETA to be within a second threshold of the desired ETV, such as ninety-eight percent. If not, all of the points with the highest VSLs equal are set to the second-highest VSLs and DT and rolling resistance are recalculated for each data point that has been modified. If the resulting profile ETA meets the second threshold, step 500 is complete. If the profile ETA is not within the second threshold, an amount of time to add to each data point is calculated and the ΔT values for each point are then saved.

Working from departure point to destination point, a new ΔT for each point selected for editing is calculated by adding the amount of time to be added to each data point to the saved ΔT and subtracting the current ΔT. The ΔT of each point (which is the distance between points divided by the average velocity between two points) will change when the VSL for the previous point changes, thus saving the previous ΔTs is important.

Starting from the departure point and working toward the destination point, a new VSL is calculated for each data point. If the calculated VSL is less than the minimum specified speed, the VSL is set to be equal to the minimum specified speed and flag is set indicating that this has occurred. The flag shall prompt this procedure to be executed again upon completion of step 412. The saved ΔT values from above are replaced by the ΔT values when the procedure is re-executed.

If the time differential is positive, i.e., the profile ETA is greater than the desired ETA, data points that may have their VSLs increased are identified if a data point is marked for coasting in steps 300 or 400, or if the VSL at the data point is less than VSL for the data point after step 200. The amount of time to subtract from each data point is calculated by dividing the difference between the profile ETA and the desired ETA by the number of points selected for editing above. Working from departure point to destination point, a new ΔT for each point selected for editing is calculated by adding the ΔT that is result of step 300 to the ΔT of step 400 ΔT and then subtracting the current ΔT. The ΔT of each point (which is the distance between points divided by the average velocity between two points) will change when the VSL for the previous point changes, so it is important to use the DT from step 400. The target ΔT is then added to the current ΔT for the current data point to find a new ΔT. The new ΔT becomes the previous ΔT if this procedure is executed again as explained below. Working from departure point to destination point, a new VSL may be calculated for each data point using Equation 9. If the calculated VSL is less than the minimum specified speed, the VSL is set to be equal to the minimum specified speed and a flag is set indicating that this has occurred. The flag shall cause the procedure to be executed again upon completion with the new ΔT values being replaced by the ΔT values calculated during re-execution of the procedure.

Regardless of whether the differential was negative or positive in step 500, the VSLs of the speed profile will need to be averaged. The reason for this is that the acceleration required to achieve the VSL at each data point with a constant ΔT causes the VSLs to oscillate. The VSLs are averaged via a moving harmonic mean due to the use of distance-based rather than time-based calculation to provide a truer average. It should be recognized that other averaging approaches could be used and might prove to be even more efficient.

Speed profiling subsystem 12 may further be programmed to determine the tractive and braking effort consumed over the course of a virtual profile once it has been completed. For example, standard train dynamic formula may be used to calculate the expected tractive and braking effort at each data point and accumulated as a measure of the total traction/braking energy of the route. Fuel consumption may then be estimated from the total traction energy value of the route.

Speed profiling subsystem 12 may further be programmed to determine the estimated time of arrival to any point on the track within the bounds of the virtual profile for display to a user. Equation 2 can be used to calculate the time between any series of VSLs. Therefore, the time required to travel between the present location of the train and any other location existing within the speed profile can be calculated on demand, as well as the time between a future location and any subsequent location.

Speed profiling subsystem 12 is also capable of tracking the performance of the train relative to the speed profile in real time by comparing the actual speed of the train to the VSL of each data point that is passed. The ETA at any location can be easily calculated as determining the time taken for the train to reach a location is a trivial matter. As a result, the actual performance of the train versus the virtual profile may be determined all times and used to maintain a desired schedule. Two strategies may be used to maintain a desired schedule in the event that the train is traveling faster or slower than the virtual profile. Once the difference in the virtual profile schedule and the desired schedule exceeds a pre-defined threshold, which may be configured by a user, the virtual profile can be recalculated from the present location of the train to the particular destination(s). For example, the VSLs between the present location and the destination may be adjusted to compensate for the deviation from the virtual profile. If recalculation of the entire virtual profile is not possible during operation of the train, a predetermined proportional/integral/derivative control algorithm (PID) may be used to add or subtract from the existing VSLs of data points between the train and the destination. A feedback loop could also be used to attenuate the revision of VSLs if the train becomes back on schedule and would require very little processing power.

Once the virtual profile has been generated, optimized for fuel consumption, and modified to match any desired time of arrival, the virtual profile may be used by the other subsystems of system 10, such as output through output gateway 34 for display to a user of any output device 36. For example, any or all of the virtual profile can be displayed to the driver of a train to provide the driver with the estimate ETA as well as operational suggestions designed to meet the desired ETA and reduce fuel consumption. The virtual profile may also be displayed for the train owner for management purposes, such as selecting best routes for fuel savings, managing several trains, etc.

Speed profiling subsystem 12 does not necessarily need to reside on the energy management computer onboard a locomotive. For example, if the energy management computer supports off-board communication, the speed profiling procedure may occur on a remote processor having more processing power than the on-board system and the results uploaded to the locomotive. Likewise, recalculating the speed profile to maintain a desired schedule may be requested by the onboard system, but performed by an off-board system. As an off-board system could be aware of the virtual profiles of multiple trains, this arrangement could be used to identify train meet locations and calculate intermediate target ETAs so that more than one train does not occupy the same space at the same time. In addition, if an off-board system processes a change in schedule for a given train, then it could remotely update the virtual profiles for all trains that will be affected.

The invention thus includes a method of generating a speed profile for a train, comprising the steps of allowing a user to input a destination and estimated time of arrival for a predetermined route, generating a virtual profile of the predetermined route having an estimated time of arrival at a destination based on data specific to the predetermined route and the train that is retrieved from a configuration file, modifying the virtual profile based on any acceleration and any deceleration required by the train when traversing the predetermined route as determined from the data specific to the predetermined route and the train, modifying the virtual profile to reducing any braking effort of the train along the predetermined route if the estimated time of arrival is earlier than a desired time of arrival input by a user, modifying the virtual profile to improve coasting along the predetermined route if the estimated time of arrival is earlier than the desired time of arrival input by a user, and conforming the estimated time of arrival to a desired time of arrival at the destination that is input by a user.

The virtual profile may comprises a series of equidistant data points, each of which is associated with a speed limit representing the lowest applicable speed limit for the train at the corresponding location of the predetermined route.

The step of modifying the virtual profile based on any acceleration and any deceleration comprises adjusting the speed limits for each data point based on the acceleration and deceleration that the train is capable of over the predetermined route.

The step of modifying the virtual profile to reduce any braking effort comprises reducing the speed limits of each data point prior to each data point having a speed limit reduction.

The step of modifying the speed limit to improve coasting comprises revising the speed limit for each data point where the train requires less traction energy than a predetermined threshold.

The step of conforming the estimated time of arrival to a desired time of arrival comprising adjusting the speed limits of a group of data points, each of which has a speed limit that may be increased or decreased and has not been increased or decreased in any previous step.

What is claimed is:

1. A train speed profiling system, comprising:

a train management computer having a train dynamic modeling engine, an input gateway for receiving input data including a track profile for a predetermined route, a consist definition, and a desired time of arrival at a destination, and an output gateway;

wherein the train management computer further includes a speed profiling subsystem having a first module that can generate a virtual profile of the predetermined route having the estimated time of arrival at the destination based on the track profile and the consist definition, a second module that can modify the virtual profile based on any acceleration and any deceleration required by the train when traversing the predetermined route, a third module that can modify the virtual profile to reduce any braking effort of the train along the predetermined route, a fourth module that can modify the virtual profile to improve any coasting along the predetermined route, and a fifth module that can conform the estimated time of arrival to the desired time of arrival at the destination that is input by a user; and wherein the train management computer is programmed to provide the virtual profile via the output gateway for operation of the train according to the virtual profile.

2. The system of claim 1, wherein modification of the virtual profile by the third module to reduce any braking effort only occurs if the estimated arrival time after modification of the virtual profile based on any acceleration and any deceleration is earlier than the desired arrival time.

3. The system of claim 2, wherein the modification of the virtual profile to improve coasting by the fourth module only occurs if the estimated arrival time after modification of the virtual profile by the third module is earlier than the desired arrival time.

4. The system of claim 3, wherein the virtual profile comprises a series of equidistant data points, each of which is associated with a speed limit representing the lowest applicable speed limit for the train at the corresponding location of the predetermined route.

5. The system of claim 4, wherein the first module is programmed to generate the virtual profile by loading the data from a configuration file, creating tables of operational information, generating a preliminary virtual profile having equidistant data points, and then finalizing the virtual profile by adjusting based on the maximum speed achievable by the train on any grades in the predetermined route.

6. The system of claim 5, wherein the second module is programmed to modify the virtual profile based on any acceleration and any deceleration by adjusting the speed limits for each data point based on the acceleration and deceleration that the train is capable of over the predetermined route.

7. The system of claim 6, wherein the third module is programmed to modify the virtual profile to reducing any braking effort by reducing the speed limits of each data point prior to each data point having a speed limit reduction.

8. The system of claim 7, wherein the third module is programmed to not reduce the speed limit of each prior data point if the reduced speed limit for a specific data point falls below a minimum speed limit for such data point.

9. The system of claim 8, wherein the fourth module is programmed to revise the speed limit for each data point where the train requires less traction energy than a predetermined threshold.

10. The system of claim 9, wherein the fifth module is programmed to conform the estimated time of arrival to a desired time of arrival by adjusting the speed limits of a group of data points, each of which has a speed limit that may be increased or decreased and has not been increased or decreased by any of the second, third, or fourth modules.

11. The system of claim 1, further comprising a sixth module programmed to generate and send at least one prompt to a user according to the virtual profile.

12. The system of claim 11, wherein the sixth module is programmed to generate and send at least one prompt to a user according to the virtual profile if there is a deviation between a desired schedule by more than a predetermined threshold.

13. The system of claim 12, wherein the at least one prompt reflects the deviation between the virtual profile and a desired schedule.

14. The system of claim 13, wherein the at least one prompt comprises a proposed driving change that is calculated to correct the deviation between the virtual profile and a desired schedule estimated arrival time.

15. The system of claim 11, wherein the at least one prompt comprises an estimated arrival time.

* * * * *